United States Patent [19]

Hardy

[11] Patent Number: 4,838,008

[45] Date of Patent: Jun. 13, 1989

[54] CLOSING PLASTICS CONTAINERS

[75] Inventor: Peter D. Hardy, Oxfordshire, United Kingdom

[73] Assignee: Metal Box plc, Reading, United Kingdom

[21] Appl. No.: 94,553

[22] Filed: Sep. 9, 1987

[30] Foreign Application Priority Data

Sep. 12, 1986 [GB] United Kingdom ..... 8622089

[51] Int. Cl.[4] ..... B65B 7/28

[52] U.S. Cl. ..... 53/407; 53/425; 53/478

[58] Field of Search ..... 53/407, 478, 477, 489, 53/485, 403, 426, 425

[56] References Cited

U.S. PATENT DOCUMENTS 2,519,353 8/1950 Cassady ..... 53/407 X
3,289,383 12/1966 Foss ..... 53/478 X
3,517,475 4/1968 Balocca .
3,545,163 12/1970 Mahffy et al. .
3,714,758 2/1973 Vogeleer ..... 53/478 X
4,424,659 1/1984 Perigo et al. .

FOREIGN PATENT DOCUMENTS 595362 12/1947 United Kingdom ..... 53/407
1131629 10/1968 United Kingdom .
1445530 8/1976 United Kingdom .

*Primary Examiner*—James F. Coan

[57] ABSTRACT

Thermally processable plastics tubs (10) filled with a liquid or semi-liquid product so as to leave a headspace are closed by preformed lids (12) which are heat-sealed to their peripheral flanges when the headspace is filled with steam. In order to prevent the steam from affecting the heat-sealing operation, the lid flanges are wider than the container flanges, and their projecting annular parts (29) are engaged so as to form a barrier separating the steam from the heated heat-sealing head.

7 Claims, 7 Drawing Sheets

CLOSING PLASTICS CONTAINERS

Figure 1:
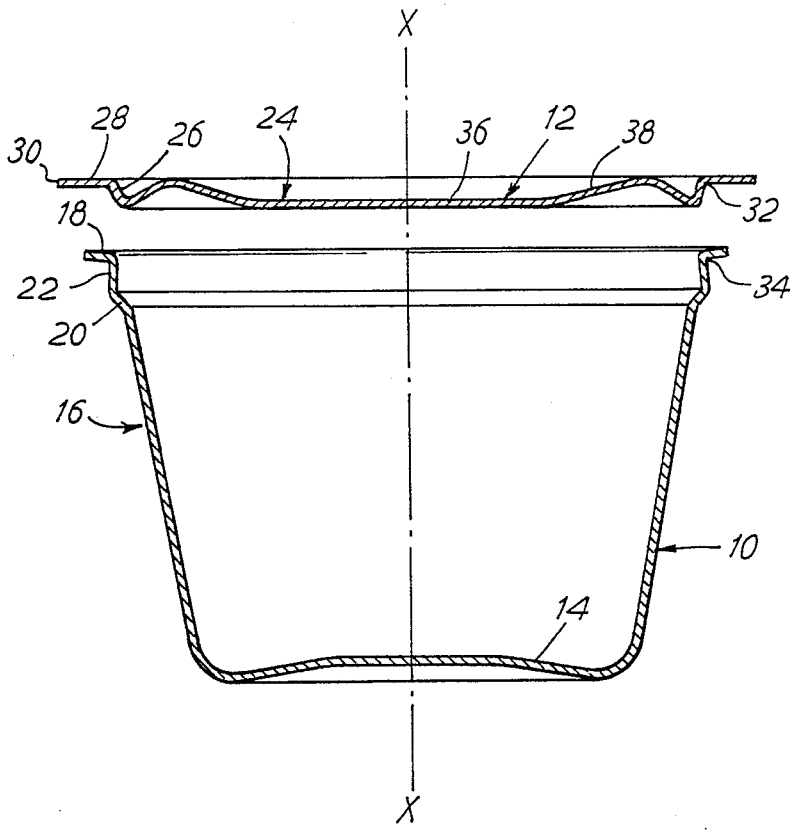

This invention relates to packages of a liquid or semi-liquid product, e.g. a food product for human consumption, of the kind having a plastics container and a flexible diaphragm closure which is heat-sealed to a flange forming a rim around the container mouth.

One such package is destined to be thermally sterilised together with its contents following the attachment of the diaphragm, and in order to prevent or substantially reduce deformation of the heat-softened plastics material of the container during and after the sterilisation process, it is known from our UK Pat. Specification No. 2067157 (Agents Ref. E2252) that the package should be substantially free of any permanent gas. Furthermore from UK Pat. Specification No. 2067157, it is known that in order to ensure the seal integrity of the diaphragm, the latter should be closed onto a headspace in which a substantially reduced (i.e. subatmosphere) pressure exists; the diaphragm is subsequently deformed onto the product, so removing the headspace and rendering the package substantially void-free as desired.

In the process and apparatus specifically described in UK Pat. Specification No. 2067157 with reference to the drawings, the substantially reduced pressure is produced by mechanical evacuation using, for example, a vacuum pump. This method is readily controllable and enables a high degree of evacuation to be achieved; however, it is inherently slow, and steam flow closing, that is to say, purging the headspace with steam and allowing the steam to condense to create the reduced pressure, may be preferred to mechanical evacuation for some applications and with some sterilisation regimes.

One problem encountered by Applicants in attempting to apply steam flow closing to the process generally taught and claimed in UK Pat. Specification No. 2067157 is the cooling effect of the steam and any condensate upon the heat-sealing operation. This problem is particularly acute if the diaphragm closure is to be formed from precut lids rather than from reel-fed material which is severed from the closed package after the heat-sealing operation. The present invention seeks to provide a method of steam flow closing a plastics container by heat-sealing a preformed lid such that the steam and any condensate are substantially prevented from affecting the heat-sealing operation so that predictable heat-sealing can be achieved over long production runs and at high production speeds.

Accordingly, from one aspect, the invention provides a method of closing a plastics container of a liquid or semi-liquid product, which method comprises:

(a) preforming, from a flexible material which is heat-sealable to the container, a lid which is capable of being loosely located on a mouth-defining rim of the container in nested relationship therewith, with an annular part of the lid projecting beyond the free edge of said rim;

(b) loosely locating the lid on the container in the said nested relationship therewith, thereby defining a headspace above the product;

(c) gripping the projecting annular part of the nested lid around its circumference and forming a moisture barrier therewith;

(d) separating the gripped lid and the container to form a gap between the container rim and the lid;

(e) directing steam into the headspace through the said gap so as to purge the headspace of the gas therein, the steam being prevented by the moisture barrier from any substantial access to the side of the lid remote from the container;

(f) bringing the container and lid together to enclose the steam-filled headspace;

(g) applying heat and pressure so as by heat-sealing the lid peripherally to the container rim to hermetically close the headspace by a reshapable diaphragm, the heat for heat-sealing being supplied from the side of the lid remote from the container;

(h) allowing or causing the steam in the headspace to condense so that the headspace is substantially free of permanent gas; and (i) allowing or causing the diaphragm to be deformed into substantially full contact with the product and thereby form the container and lid into a substantially void-free, product-filled package.

The invention also provides, according to further aspects thereof, an apparatus suitable for performing the method defined above, and a package such as could be produced by the method and apparatus.

According to the invention from a second aspect there is provided an apparatus for closing a plastics container, of a liquid or semi-liquid product, which apparatus comprises:

(a) lid forming means adapted for forming from a flexible material which is heat-sealable to the container a lid which is shaped and dimensioned to be loosely located on a mouth-defining rim of the container in nested relationship therewith, with an annular part of the lid projecting beyond the free edge of the said rim;

(b) lid location means adapted for locating the lid on the container in the said nested relationship, thereby defining a headspace above the product;

(c) gripping means adapted for gripping the projecting annular part of the nested lid around its circumference and forming a moisture barrier therewith;

(d) transport means adapted to cause relative separating movement of the gripped lid and the container whereby to form a gap between the container rim and the lid;

(e) steam supply means adapted for supplying steam into the headspace through the said gap so as to purge the headspace of the gas therein, the steam being prevented by the moisture barrier from any substantial access to the side of the lid remote from the container;

(f) first and second relatively movable heat-sealing heads disposed respectively adjacent the lid and the container rim and adapted by mutual cooperation to heat-seal the lid peripherally to the container rim;

(g) heating means adapted for permanently heating the first heat-sealing head; and (h) actuation means adapted, after the container and lid have been brought together again by the transport means following the steam purging operation, to bring the heated first heat-sealing head and the second heat-sealing head into cooperation whereby to effect heat-sealing of the lid to the container rim.

Preferably the apparatus further includes a plunger which is adapted, following the operation of the actuation means, to engage the lid within the container rim and thereby deform or reshape it to a desired shape. Furthermore, the gripping means is preferably arranged to form a part of a valve by which the admission of steam to the said gap formed by the transport means is controlled, the valve being open when the gripping means is effective, but being closed when the gripping means is ineffective.

According to the invention from a third aspect there is provided a substantially void-free package of a liquid or semi-liquid product, which comprises a plastics container of the product and having a mouth-defining rim, and a diaphragm closure of a flexible material which is heat-sealed to the container rim and within the rim is dished inwardly of the container onto the product so that little or no permanent gas exists in the package, wherein the product includes a small proportion of the condensate of steam used in a steam flow closing opeation of the container. Preferably, and as in the described embodiment, the diaphragm closure is extended beyond the free edge of the rim as a projecting part thereof, and the projecting part is downturned over the rim free edge to an unobtrusive position.

These and other aspects and features of the invention will now become apparent from the following description of an embodiment thereof, now to be described with reference to the accompanying diagrammatic drawings. In the drawings:

FIG. 1 is a central vertical section of a plastics tub which is to be closed in accordance with the invention after product filling, and a lid which is to form the closure for the tub, the tub and lid being shown in exploded view; and FIGS. 2A to 2F show successive stages in the attachment of the lid to the tub.

Referring firstly to FIG. 1, product-filled circular plastics tubs 10 are to be closed by means of preformed circular lids 12 which have been pressed and cut from a plastics-coated metal (e.g. aluminium) foil typically having a thickness of 0.5 mm. The tubs are made by a thermoforming operation performed on substantially rigid polypropylene or polypropylene-based plastics sheet, which may if desired include an internal layer of a suitable barrier plastics material such as polyvinylidene chloride (PVdC) or ethylene vinyl alcohol (EVOH), and one or more further internal layers of reclaim material. The tubs are destined, following closing by a lid 12, to be thermally sterilised together with their contents in a suitable steam and/or water retort. The product in the tubs 10 is a liquid or semi-liquid product such, for example, as a lasagne. Typically, the plastics sheet from which the tubs 10 are formed has a thickness of 2 mm.

From FIG. 1 it can be seen that the tubs are of conventional shape. They have a generally plane and circular base 14 and a generally tapering and upwardly divergent sidewall 16 which is terminated by an annular heat-seal flange 18 around the container mouth. For stacking purposes they have an annular denesting shoulder 20 which is separated from the flange 18 by a short, reversely-tapered portion 22 of the sidewall 16.

Each lid 12 has a central panel 24 within a short, upwardly and outwardly tapering sidewall 26, and an annular peripheral flange 28 extending from the sidewall to a free edge 30. The elbow 32 between the top of the sidewall and the flange has nominally the same diameter as the elbow 34 between the sidewall 16 and flange 18 of the container, so that the lid can nest snugly in the mouth of the container with the flanges 18, 28 in contact or closely adjacent one another. For the reason later to become apparent, the lid flange 28 has a substantially greater radial width than the tub flange 18, so as to project outwardly beyond it when the lid is in nested position on the tub.

The central panel has a plane central portion 36 and an open fold or corrugation 38 by which the central portion is carried from the bottom of the sidewall 26 and which is convex to the exterior side of the lid, the upper side as shown.

FIGS. 2A to 2F show successive stages of the process by which a tub 10 is closed by a lid 12 following the filling of the tub with product and the placement of the lid loosely onto the tub by a suitable means. The tapering sidewall 26 (FIG. 1) of the lid acts as required to centre the lid in relation to the tub for the lid placement operation. A small headspace 39 (FIG. 2A) exists above the product (and beneath the lid) at this time, the free surface of the product being denoted by the reference numeral 41.

Figure 2A:
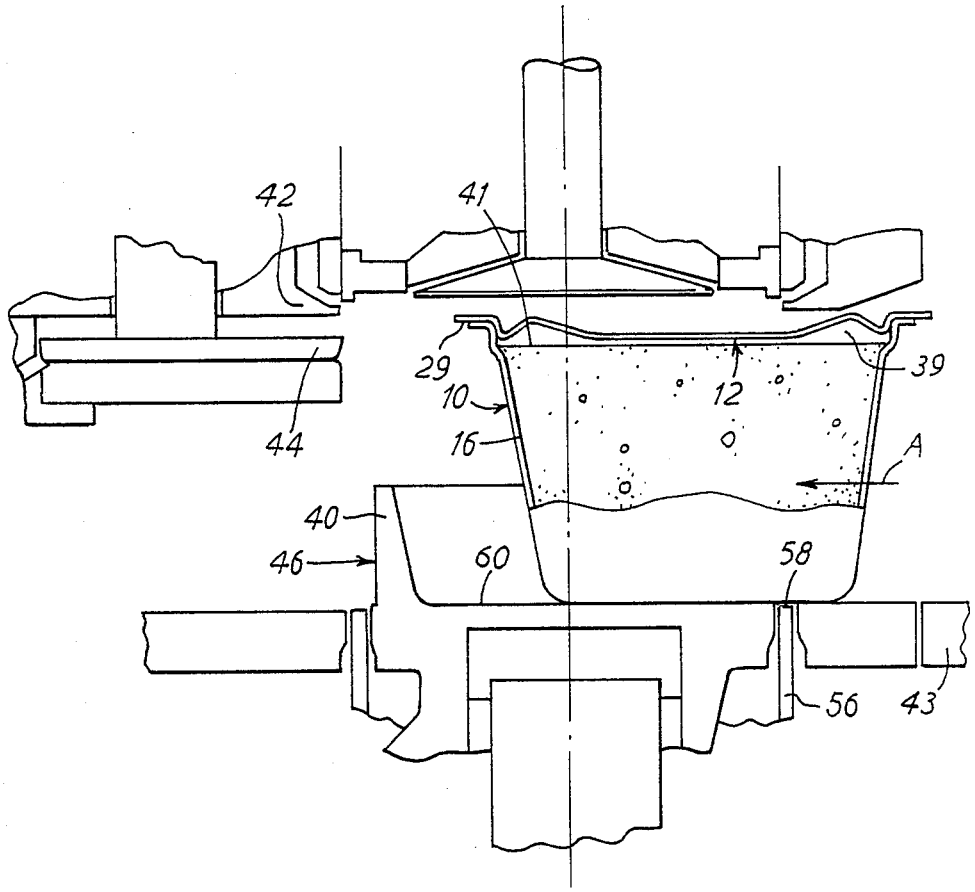

As represented in FIG. 2A by the arrow A, the tub 10 with the lid 12 placed on it enters on a conveyor 43 with a lateral, horizontal movement normal to its axis. This lateral movement is arrested by an end stop 40 engaging the bottom of its sidewall 16, following which the annular part 29 at which the lid flange 28 projects beyond the container flange 18 is clamped between upper and lower annular jaws 42, 44 by movement of the lower jaw in the upward direction; see the arrow B in FIG. 2B.

The end stop 40 forms part of a support table 46 having a surface 60 on which the container is supported. As shown in FIG. 2C, after the lid has been peripherally clamped and held by the clamping jaws 42, 44, this table is lowered—see the arrow C—to allow the tub to move downwardly away from the lid and by relative movement of the tub and lid to create a gap 48 between them. The raising of the clamping jaw 44 allows superheated steam which is permanently available at a steam conduit 50 (FIG. 2C) to enter the headspace above the product via the gap 48, so as to drive off the air and any other gases occupying the headspace and to fill the headspace in their stead. In passing from the conduit 50 to the gap 48, the steam flows between the lower clamping jaw 44 and an underlying annular plate 54, as is indicated by the arrow D; it will therefore be seen that the jaw 44 serves not only to clamp the lid 12 peripherally by cooperation with the clamping jaw 42 above it, but also, by cooperation with the plate 54 below it, it forms a valve for the superheated steam at the conduit 50 which is opened when the clamping jaws become effective.

Figure 2B:
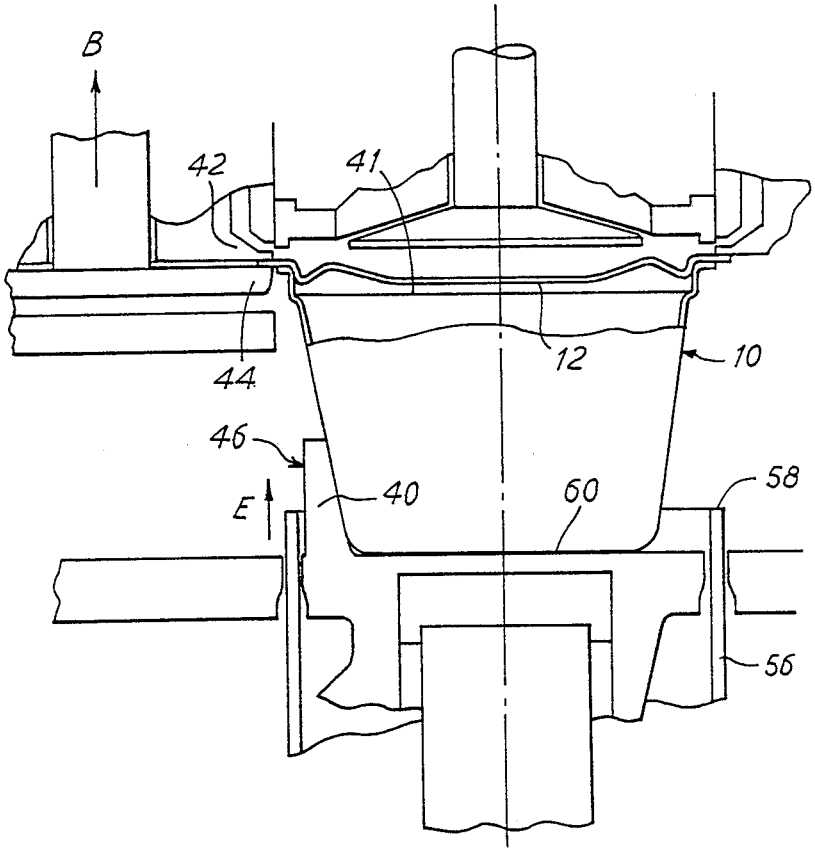
Figure 2C:
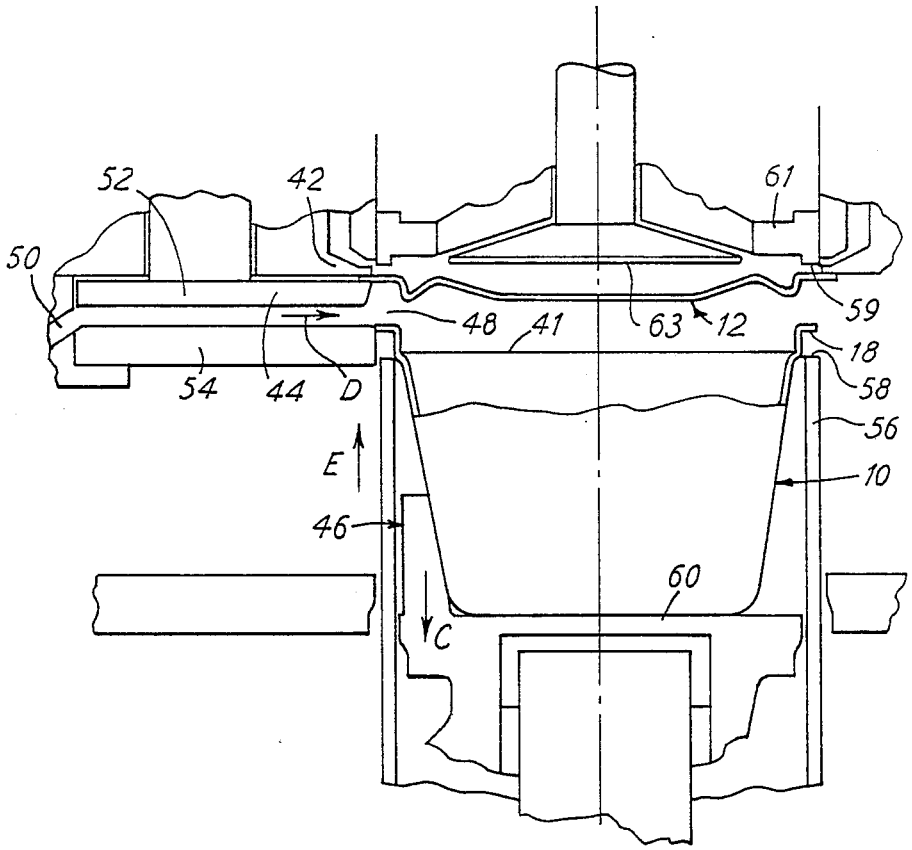
Figure 2D:
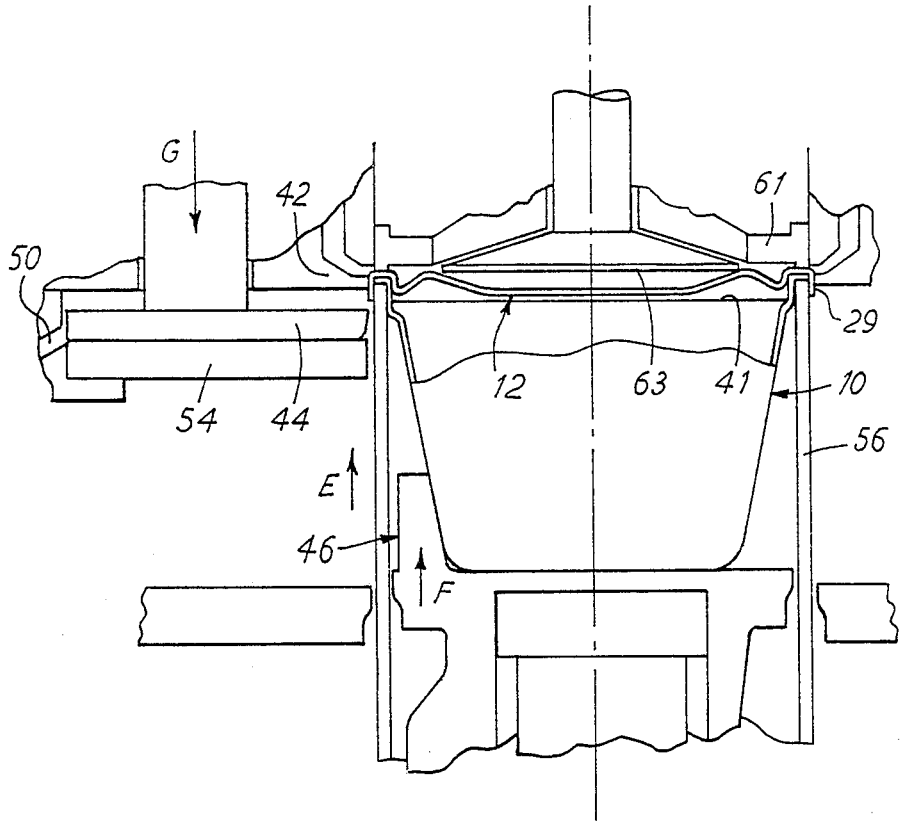

As indicated by the arrow E in FIGS. 2B, 2C and 2D, throughout the clamping of the lid periphery and the purging of the container headspace by steam, a cylindrical heat-sealing head 56 is being progressively raised from the initial, retracted position shown in FIG. 2A at which its free upper end 58 is flush with the tub support surface 60 of the table 46. The steam purging operation is completed when this head 56 comes into engagement with the undersurface of the tub flange 18 and presses it and the lid flange 28 above it firmly against a complementary heat-sealing face 59 of an annular heat-sealing head 61 which is continuously heated by an electrical heating element (not shown). In known manner heat from the upper sealing head 61 and pressure exerted by the lower sealing head 56 cause the plastics coating on the underside of the lid 12 to fuse to the upper surface of the tub flange 18, so as to combine the tub and lid together as a closed and hermetically sealed package with a steam-filled headspace. The situation is then as depicted in FIG. 2D.

The upward movement of the tub and lid necessary to achieve the position of FIG. 2D is assisted by the support table 46 which is raised in unison with the lower sealing head 56 during the latter part of the sealing head travel as indicated by the arrow F. In addition to presenting the tub and lid for heat-sealing a further effect of the upward movement of the tub and lid is to draw the projecting part 29 of the lid flange 28 from between the clamping jaws 42, 44, and to cause the free inner edge of the upper jaw 42 to fold it downwardly against the outer free edge of the tub flange 18 where it is subsequently unlikely to snag on, or become snagged by, other objects.

Release of the clamping engagement of the lid flange 28 by the clamping jaws 42, 44 is achieved by movement of the lower jaw 44 down against the annular plate 54 as indicated by the arrow G; this closes off the superheated steam by cooperation with the plate 54 and moreover moves the inner free edge of the lower jaw clear of the lid flange to allow the proper downfolding of the projecting part 29 to its unobtrusive position.

From the foregoing it will be noted that the lid 12 acts as a barrier to keep the steam (and any condensate) away from the heat-sealing head 61. The steam is at a substantially lower temperature than the head 61, and could cause substantial cooling of the head below the operating temperature if allowed to come into contact with it. The additional width of the lid flange 28 provided by the part 29 enables the lid to be clamped outside the annular heat-seal area whilst steam purging is taking place, the clamping jaws 42, 44 sealing against the lid material so as to prevent any substantial access for moisture to the upper side of the lid.

Figure 2E:
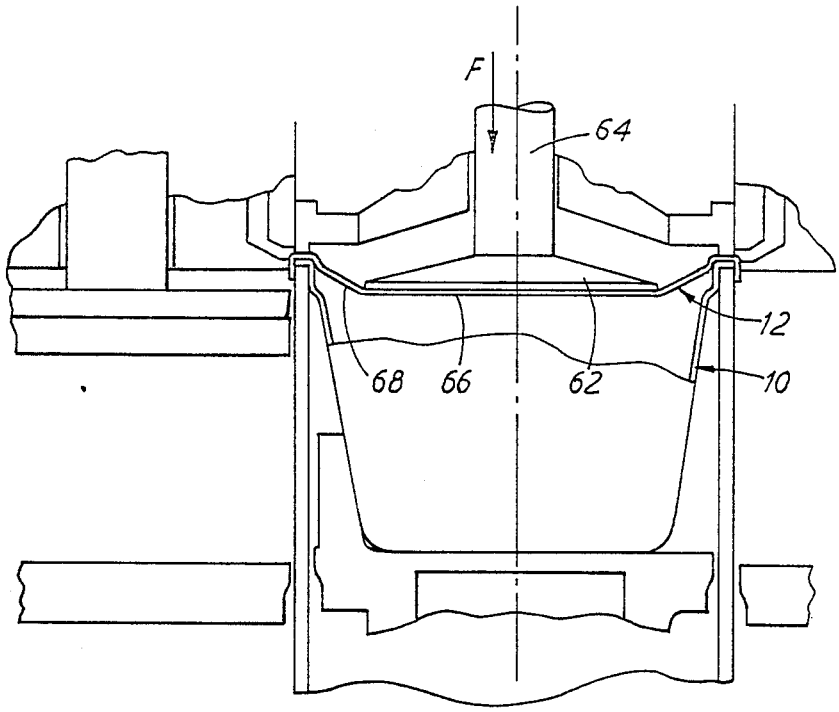

As is illustrated in FIG. 2E, while heat-sealing is proceeding the steam in the headspace progressively and naturally condenses, and a substantially subatmospheric pressure is created above the product. During the latter part of the heat-sealing operation, when the heat-seal bond has developed a substantial shear strength, a central plunger 62 mounted on a vertical shaft 64 is slowly lowered into contact with the lid 12 at its central portion 36 as indicated by the arrow F, and continues downwards until the lid makes substantially full contact with the product, that is to say, until there is little or no headspace remaining. To achieve this situation some redistribution of the product occurs at the top of the package; moreover, the sidewall 26 and fold 38 of the lid both lose their identities, and the lid within the heat-seal 28 is reformed as a first, central part in engagement with (and conforming to) the plane contact face 63 of the plunger 62, and an inclined, frustoconical second part by which the central part is joined to the heat-seal flange.

FIG. 2E illustrates the condition of the package and the apparatus at this stage of the process, the central part of the lid being denoted 66 and the inclined part being denoted 68. It is to be understood that during the deformation of the lid 12 from the condition shown in FIG. 1 and FIGS. 2A to 2D to that shown in FIG. 2E little or no extension of the lid material occurs; the deformation is essentially a reshaping operation and designed to give the lid a visually pleasing appearance. Furthermore the downward movement of the plunger 62 and its position at the end of the stroke are such that at no time does the plunger exert on the package a positive pressure substantially more than is sufficient to reshape the lid and redistribute the product as necessary. Thus, little or no residual stresses are left in the package by the closing operation.

In a modification of the described process and apparatus the plunger 64 is omitted, and the reforming of the lid is performed by differential pressure; the differential pressure may be due to atmospheric pressure alone acting on the upper side of the lid, or a superatmospheric pressure from an outside gas pressure source may be used. If desired, both mechanical and pneumatic pressure may be employed. Furthermore, rather than merely reshaping the lid as described above, the mechanical and/or pneumatic deformation can be arranged to stretch the lid inelastically onto the product in the manner specifically described in our previously mentioned UK Pat. No. 2067157.

Figure 2F:
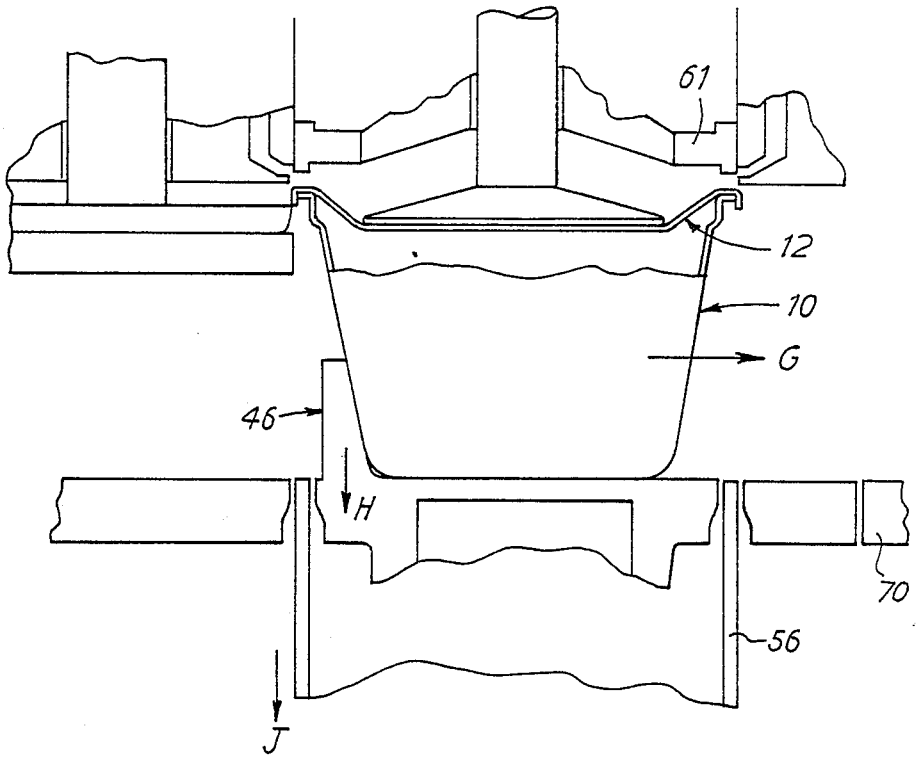

Following the deformation of the lid the table 46 and the heat-sealing head 56 are simultaneously lowered to their original positions of FIG. 2A, so disengaging the lid from the heat-sealing head 61, and allowing the closed and sealed tub 10 to move under gravity to the position shown in FIG. 2F. As indicated by the arrow G, the tub is then ejected from the apparatus across a table or deadplate 70 by lateral movement generated by a star wheel (not shown). The downward movement of the table 46 and head 56 are represented in FIG. 2F by the arrows H and J respectively.

As mentioned above, the closing operation is such as to leave the package in a substantially stress-free condition and with little or no headspace. When the package is subsequently sterilised in a steam and/or water retort it is subject to little or no permanent and visually obtrusive deformation such as might lead to consumer resistance.

A preferred apparatus (not shown) for performing the process described above has ten tables 46 and associated clamping jaws 42, 44 heat-sealing heads 56, 61 and plungers 62 which are disposed at 36° intervals around the circumference of an assembly which is driven to rotate at a constant speed about a central vertical axis.

Filled tubs 10 with lids 12 loosely placed on them are fed onto the tables in turn from an input conveyor (39) as the assembly rotates, and after movement with the assembly through approximately 320° are ejected onto a deadplate (70) and carried away by an output star wheel as filled and closed packages.

The vertical movements required for effecting the lid clamping, steam purging, heat sealing and package ejection operations as described above are generated by part-circular cam bars immovably carried from the machine frame concentrically with the axis of rotation of the rotary assembly. Two cam bars are provided for the lower clamping jaw 44 and the plunger 62 respectively and operate against return springs biassing those items in the upward direction. Further cam bars control the vertical positions of the tables 46 and the lower heat-sealing head 56 in both the upward and downward direction. The cam bars are engaged by cam follower rollers in each case.

In a possible modification of the described embodiment the projecting parts 29 of the lids are severed from the packages instead of being downturned to unobtrusive positions as described.

I claim:

1. A method of closing a plastics container of a product, which method comprises:

(a) locating a lidding material which is heat-sealable to the container, over a mouth-defining rim of the container, (b) directing steam between the lidding material and the container rim and into the space between the lid and the product in the container to purge said space of gas, (c) and heat sealing the lidding material to the rim using a heated element located on the side of the lidding material remote from the container characterised in that:

(d) the lidding material is in the form of an individual lid for the container, and (e) during step (b) the circumference of said lid is maintained in engagement with an element which, in conjunction with the lid, forms a moisture barrier between the steam-containing region and the heated element so as to keep steam away from the heated element.

2. A heat sealed container and its associated product made according to the process of claim 1.

3. An apparatus for closing a plastics container of a liquid or semi-liquid product, which comprises:

(a) lid forming means adapted for forming from a flexible material which is heat-sealable to the container a lid which is shaped and dimensioned to be loosely located on a mouth-defining rim of the container in nested relationship therewith, with an annular part of the lid projecting beyond the free edge of the said rim;

(b) lid location means adapted for locating the lid on the container in the said nested relationship, thereby defining a headspace above the product;

(c) gripping means adapted for gripping the projecting annular part of the nested lid around its circumference and forming a moisture barrier therewith:

(d) transport means adapted to cause relative separating movement of the gripped lid and the container whereby to form a gap between the container rim and the lid;

(e) steam supply means adapted for supplying steam into the headspace through the said gap so as to purge the headspace of the gas therein, the steam being prevented by the moisture barrier from any substantial access to the side of the lid remote from the container;

(f) first and second relatively movable heat-sealing heads disposed respectively adjacent the lid and the container rim and adapted by mutual cooperation to heat-seal the lid peripherally to the container rim;

(g) heating means adapted for permanently heating the first heat-sealing head; and (h) actuation means adapted, after the container and lid have been brought together again by the transport means following the steam purging operation, to bring the heated first heat-sealing head and the second heat-sealing head into cooperation whereby to effect heat-sealing of the lid to the container rim.

4. A method of closing a plastics container of a product, which method comprises:

(a) locating a lidding material which is heat-sealable to the container, over a mouth-defining rim of the container, (b) directing steam into the space between the lid and the product in the container to purge said space of as, (c) and heat sealing the lidding material to the rim using a heated element located on the side of the lidding material remote from the container characterised in that:

(d) the lidding material is in the form of an individual preformed lid for the container, (e) the lid is bodily supported at a spacing from the rim and the steam is directed through said spacing, and (f) during step (b) the circumference of said lid is maintained in engagement with an element which, in conjunction with the lid, forms a moisture barrier between the steam-containing region and the heated element so as to keep steam away from the heated element.

5. A heat sealed container and its associated product made according to the process of claim 4.

6. A method of closing a plastics container of a liquid or semi-liquid product, which method comprises:

(a) preforming, from a flexible material which is heat-sealable to the container a lid which is capable of being loosely located on a mouth-defining rim of the container in nested relationship therewith, with an annular part of the lid projecting beyond the free edge of said rim;

(b) loosely locating the lid on the container in the said nested relationship therewith, thereby defining a headspace above the product;

(c) gripping the projecting annular part of the nested lid around its circumference and forming a moisture barrier therewith;

(d) separating the gripped lid and the container to form a gap between the container rim and the lid;

(e) directing steam into the headspace through the said gap so as to purge the headspace of the gas thereon, the steam being prevented by the moisture barrier from any substantial access to the side of the lid remote from the container;

(f) bringing the container and lid together to enclose the steam-filled headspace;

(g) applying heat and pressure so as by heat-sealing the lid peripherally to the container rim to hermetically close the headspace by a reshapable diaphragm, the heat for heat-sealing being supplied from the side of the lid remote from the container;

(h) allowing or causing the steam in the headspace to condense so that the headspace is substantially free of permanent gas; and (i) allowing or causing the diaphragm to be deformed into substantially full contact with the product and thereby form the container and lid into a substantially void-free, product-filled package.

7. A heat sealed container and its associated product made according to the process of claim 6.

* * * * *